US009909583B2

(12) United States Patent
Moetakef

(10) Patent No.: US 9,909,583 B2
(45) Date of Patent: Mar. 6, 2018

(54) GEROTOR PUMP FOR A VEHICLE

(71) Applicant: Ford Global Technologies, LLC, Dearborn, MI (US)

(72) Inventor: Mohammad Ali Moetakef, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 178 days.

(21) Appl. No.: 14/929,759

(22) Filed: Nov. 2, 2015

(65) Prior Publication Data

US 2017/0122311 A1 May 4, 2017

(51) Int. Cl.

| | |
|---|---|
| ***F01C 1/08*** | (2006.01) |
| ***F04C 2/08*** | (2006.01) |
| ***F04C 18/08*** | (2006.01) |
| ***F04C 15/00*** | (2006.01) |
| ***F04C 2/10*** | (2006.01) |
| ***F01M 1/02*** | (2006.01) |

(52) U.S. Cl.
CPC ..... *F04C 2/10* (2013.01); *F01M 1/02* (2013.01); *F01M 2001/0238* (2013.01)

(58) Field of Classification Search
USPC ..... 418/183, 186, 187, 61.3, 57, 74, 166, 418/171, 132, 270, 190, 259, 53, 68
See application file for complete search history.

(56) References Cited

U.S. PATENT DOCUMENTS

| | | | | |
|---|---|---|---|---|
| 3,007,419 | A | 11/1961 | Burt | |
| 3,145,662 | A | 8/1964 | Eickmann | |
| 3,917,437 | A | 11/1975 | Link | |
| 4,235,217 | A * | 11/1980 | Cox | F01C 1/103 123/232 |
| 5,064,362 | A | 11/1991 | Hansen | |
| 7,481,633 | B2 | 1/2009 | White, Jr. | |
| 7,618,247 | B1 | 11/2009 | Niemiec | |
| 7,832,997 | B2 * | 11/2010 | Williamson | F01C 21/108 418/21 |
| 2002/0076345 | A1 | 6/2002 | Hansen | |
| 2011/0194968 | A1 | 8/2011 | Nakagawa et al. | |
| 2015/0315913 | A1 | 11/2015 | Peter | |

FOREIGN PATENT DOCUMENTS

| | | | |
|---|---|---|---|
| EP | 0466351 | A1 | 1/1992 |
| JP | 2002276559 | A | 9/2002 |
| KR | 1020060025367 | A | 3/2006 |
| WO | 2004046554 | A1 | 6/2004 |

* cited by examiner

*Primary Examiner* — Mark Laurenzi
*Assistant Examiner* — Deming Wan
(74) *Attorney, Agent, or Firm* — Brooks Kushman P.C.; Greg Brown

(57) ABSTRACT

A gerotor pump is provided with a pump housing defining a chamber and having an inlet and an outlet separated by a planar surface. The planar surface defines a notch connected to the outlet. An inner gear member is rotatably and eccentrically supported within an outer gear member. The inner gear member defines a series of external teeth with a first tooth defining a fluid passage therethrough and a second tooth independent of fluid passages. The fluid passage is defined by an aperture extending axially through the first tooth fluidly connected to a channel extending across the first tooth on an end face of the inner gear member. The passage and the notch cooperate to form a fluid pathway for pressure relief and reduced tonal noise in the pump by disrupting harmonics during operation.

17 Claims, 4 Drawing Sheets

GEROTOR PUMP FOR A VEHICLE

TECHNICAL FIELD

Various embodiments relate to a gerotor oil pump for a powertrain component such as an internal combustion engine or a transmission in a vehicle.

BACKGROUND

An oil pump is used to circulate oil or lubricant through powertrain components such as an engine or a transmission. The oil pump is often provided as a generated rotor or gerotor pump. Gerotor pumps have a positive displacement characteristic and tight clearances between various components of the pump that result in the formation of pressure ripples or fluctuations of the fluid within the pump and the attached oil galleries during operation of the pump. The pressure ripples of the fluid in the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue, and mitigation techniques may include countermeasures such as damping devices that are added to the powertrain to reduce noise induced by a conventional pump.

SUMMARY

In an embodiment, a gerotor pump is provided with a pump housing defining a chamber and having a fluid inlet and a fluid outlet. An outer gear member is supported for rotation within the chamber about a first axis, with the outer gear member having a series of internal teeth. An inner gear member is rotatably supported within the outer gear member about a second axis spaced apart from the first axis. The inner gear member defines a series of external teeth with a first tooth defining a fluid passage therethrough and a second tooth independent of fluid passages. The fluid passage is defined by an aperture extending axially through the first tooth fluidly connected to a channel extending across the first tooth on an end face of the inner gear member. The fluid passage is configured to disrupt harmonics during operation to reduce pressure ripples and associated tonal noise.

In another embodiment, a gerotor pump is provided with a housing having a planar surface separating an inlet and an outlet in a chamber and defining a notch connected to the outlet. An inner rotor is positioned within an idler rotor, and has a first tooth defining a passage therethrough and a second tooth independent of passages. The passage and the notch cooperate to form a fluid pathway for pressure relief and reduced tonal noise in the pump.

In yet another embodiment, an inner rotor for a gerotor pump is provided with a body having first and second ends separated by an outer wall defining a series of (N) teeth. The body has (N/2) or fewer teeth each defining a passage, with the (N/2) or fewer teeth being nonsequentially arranged in the series of teeth. Each passage has an axial aperture extending through the body and intersecting a groove defined by the first end and extending across the respective tooth.

Various embodiments according to the present disclosure have associated, non-limiting advantages. For example, a gerotor oil pump may be provided with an inner rotor with a fluid passage extending through at least one, but not all of the teeth. The fluid passage cooperates with a notch formed in the pump housing and/or cover when they are in register or aligned with one another. By putting fluid passageways on some teeth of the inner rotor, while leaving the remaining teeth without fluid passageways therethrough, the main harmonics of the oil pump can be broken into lower peaks resulting in reduced pressure ripples and oil pump tonal noise.

DETAILED DESCRIPTION

Figure 1:
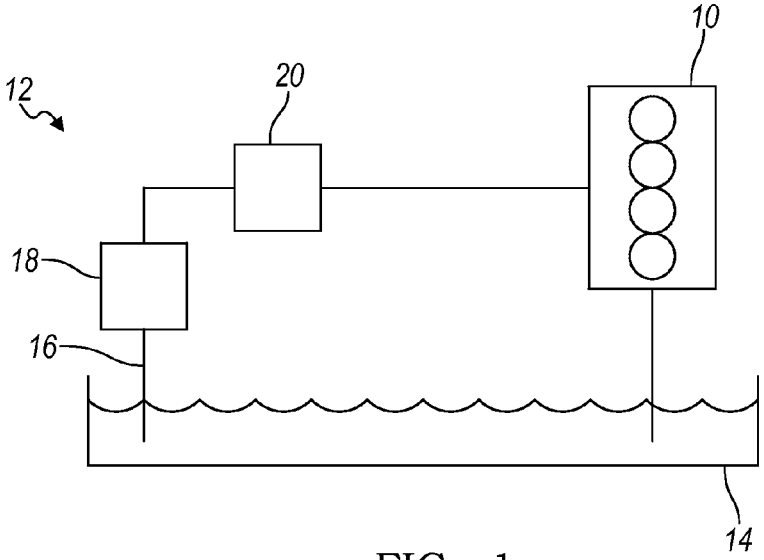
FIG. 1 illustrates a schematic of a lubrication system for a component in a vehicle according to an embodiment.

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A vehicle component 10, such as an internal combustion engine or transmission in a vehicle, includes a lubrication system 12. The vehicle component 10 is described herein as an engine, although use with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate rotating bearings, moving pistons and engine camshaft. The lubrication system 12 may additionally provide cooling of the engine. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer and is in fluid contact with oil in the sump 14.

The pump 18 receives oil from the intake 16 and pressurizes and drives the oil such that it circulates through the system 12. The pump 18 is described in greater detail below with reference to FIGS. 2-6. In one example, the pump 18 is driven by a rotating component of the engine 10, such as a belt or mechanical gear train driven by the camshaft. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, and the like.

In other examples, the pump 18 may be implemented on other vehicle systems, for example, as a fuel pump, and the like.

FIGS. 2-6 illustrate a pump 50 and various components thereof. The pump 50 may be used in the lubrication system 12 as pump 18. The pump 50 has a housing 52 and a cover 54. The housing 52 and the cover 54 cooperate to form an internal chamber 56. The cover 54 connects to the housing 52 to enclose the chamber 56. The cover 54 may attach to the housing 52 using one or more fasteners, such as bolts, or the like. A seal, such as an O-ring or a gasket, may be provided to seal the chamber 56.

The internal chamber 56 may be provided with or defined by a substantially cylindrical support or guide wall 57. The guide wall 57 may include one or more sections of wall that have a common radius of curvature and center. Various sections of the guide wall 57 may lie about a perimeter of a common cylinder.

Figure 2:
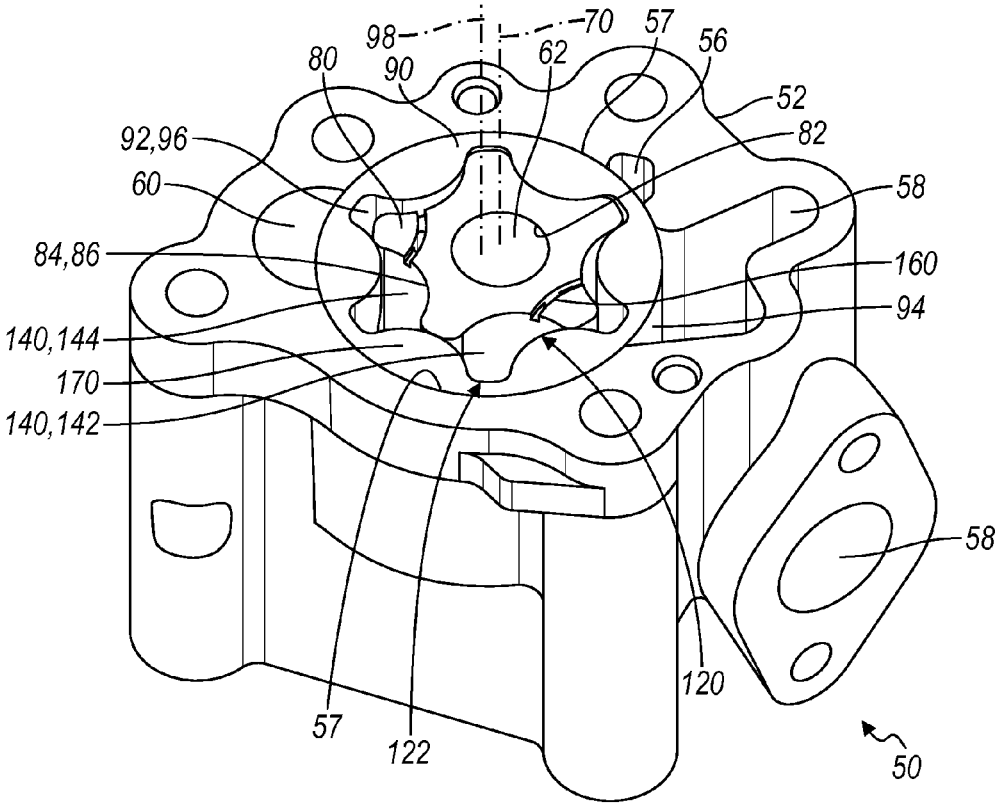
FIG. 2 illustrates a perspective partial view of gerotor pump according to an embodiment.

The pump 50 has a fluid inlet 58 and a fluid outlet 60. The fluid inlet 58 has an inlet port as shown in FIG. 2 that is adapted to connect to a conduit such as intake 16 in fluid communication with a supply, such as an oil sump 14. The inlet port may be located on the housing 52 as shown, or may be defined by the cover 54. The fluid inlet 58 is fluidly connected with the chamber 56 and intersects the wall(s) 57 such that fluid within the inlet 58 flows into the chamber 56. Both the housing 52 and the cover 54 may define portions of the inlet 58 region. The inlet 58 may be shaped to control various fluid flow characteristics.

Figure 3:
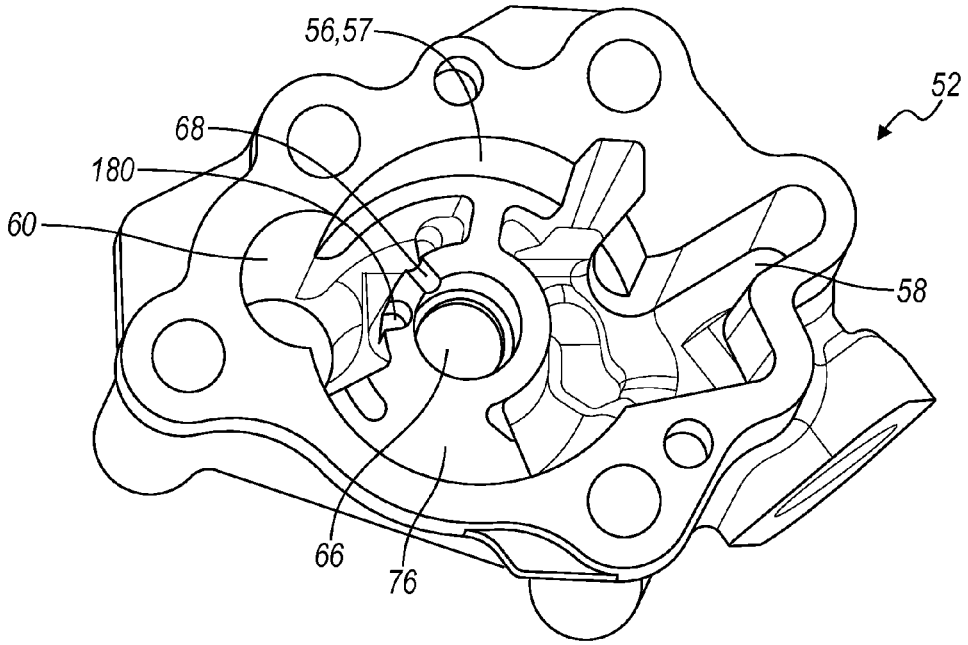
FIG. 3 illustrates a body of a pump housing of the gerotor pump of FIG. 2.
Figure 4:
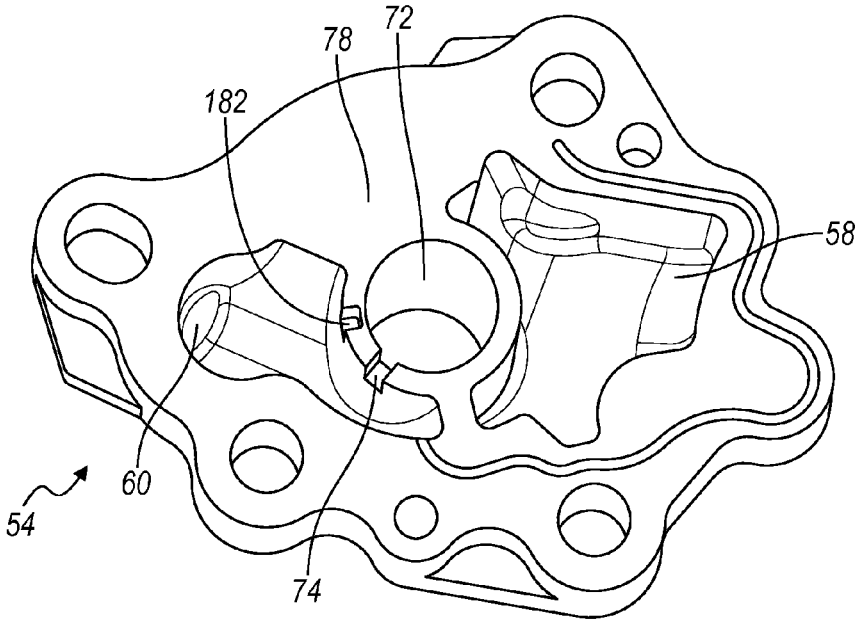
FIG. 4 illustrates a cover of the pump housing of the gerotor pump of FIG. 2.

The fluid outlet 60 has an outlet port as shown in FIG. 3 that is adapted to connect to a conduit in fluid communication with an oil filter, a vehicle component such as an engine, etc. The outlet port may be located on the housing 52 as shown, or may be defined by the cover 54. The fluid outlet 60 is fluidly connected with the chamber 56 and intersects the wall(s) 57 such that fluid within the chamber 56 flows into the outlet 60. Both the housing 52 and the cover 54 may define portions of the outlet 60 region. The outlet 60 may be shaped to control various fluid flow characteristics. The inlet 58 and the outlet 60 are spaced apart from one another by a section of wall 57, and in one example, may be generally opposed to one another.

The pump 50 has a pump shaft 62 or driveshaft. The pump shaft 62 is driven to rotate components of the pump 50 and drive the fluid. In one example, the pump shaft 62 is driven by a mechanical coupling with an engine, such that the pump shaft rotates as an engine component such as a crankshaft rotates, and a gear ratio may be provided to provide a pump speed within a predetermined range. In one example, an end of the pump shaft 62 is splined or otherwise formed to mechanically connect with a rotating vehicle component to drive the pump 50.

The other end of the shaft 62 is supported for rotation within the housing 52 of the pump 50. The housing may define a support 66 for the end of the shaft to rotate therein. The support 66 may include a bushing, a bearing connection, or the like. A lubrication passage 68 may be provided in the housing 52 to lubricate the bearing connection in the support 66. The shaft 62 rotates about a longitudinal axis 70 of the shaft 62.

The shaft 62 extends through the cover 54, and the cover 54 defines an opening 72 for the shaft 62 to pass through. The opening 72 may include a sleeve or a seal to retain fluid within the pump and prevent or reduce leakage from the chamber 56. The opening 72 may also include additional bushings or bearing assemblies supporting the shaft 62 for rotation therein. A lubrication passage 74 may be provided in the cover 54 to lubricate the bearing connection in the opening 72.

The housing 52 has a planar surface 76 that extends between the inlet and outlet regions 58, 60 and surrounds the driveshaft 62. The cover 54 also has a planar surface 78 that extends between the inlet and outlet regions 58, 60 and surrounds the driveshaft 62.

An inner rotor 80 or inner gear member is connected to the pump shaft 62 for rotation therewith. The inner rotor 80 has a body defining an inner surface or wall 82 and an outer surface or wall 84. The inner wall 82 is formed to couple with the pump shaft 62 for rotation therewith about the axis 70. In one example, the inner wall 82 is splined to mate with a corresponding splined section of the pump shaft 62. The outer wall 84 defines a series of external gear teeth 86. The inner rotor 80 may be defined as an externally toothed gear.

An outer rotor 90, outer gear member, or idler gear or rotor surrounds the inner rotor 80 and is supported for rotation within the chamber 56. The outer rotor 90 has an inner surface or wall 92 and an outer surface or wall 94. The inner wall 92 defines a series of internal gear teeth 96. The outer rotor 90 may be defined as an internally toothed gear. The outer wall 94 is cylindrical in shape and is sized to be received by and generally interface with the cylindrical wall sections of the housing for rotation therein about an axis 98. Axis 98 is the longitudinal or central axis of the cylindrical chamber 56 in the housing. The outer wall 94 may be directly adjacent to and may contact the cylindrical wall sections 57, as the wall sections 57 act to retain the outer rotor 90 in position during pump 50 operation.

The inner rotor 80 is rotated about axis 70 by the pump shaft 62. The series of teeth 86 on the inner rotor 80 have an addendum region 104 and a dedendum region 106. The addendum region 104 is adjacent to the top land 108 of each tooth 110. The dedendum region 106 is adjacent to the bottom land 112 between adjacent teeth 110. Each of the addendum and dedendum regions 104, 106 may be formed by a cycloid shape, or another shape. In the example shown, the dedendum region 106 is formed by a cycloid or a hypocycloid shape such that the dedendum regions 106 are smooth curves.

The outer rotor 90 has a series of inner gear teeth 96 that have an addendum region 120 and a dedendum region 122. The addendum region 120 is adjacent to the top land of each tooth and the dedendum region 122 is adjacent to the bottom land between adjacent teeth. Each of the addendum and dedendum regions 120, 122 may be formed by a cycloid shape, or another shape. In the example shown, the addendum region 120 is formed by a cycloid or a hypocycloid shape such that the addendum regions 120 are smooth curves. The addendum region 120 is formed with the same curve or shape as the dedendum region 106 of the inner rotor 80 such that the regions 106, 120 mate to form a continuous seal.

As the inner rotor 80 is rotated by the shaft 62, the teeth 86 of the inner rotor 80 mesh with the teeth 96 of the outer rotor 90, and the outer rotor 90 is driven as an idler by the inner rotor 80. In the present example, the pump shaft 62 rotates the inner rotor 80 in a clockwise direction in FIG. 2, and the idler rotor 90 is therefore rotated in a clockwise direction by the inner rotor 80. The inner rotor 80 is eccentric relative to the outer rotor 90 and the cylindrical housing 56, 57. As the inner rotor 80 rotates about an axis 70 that is offset relative to the axis of rotation 98 of the outer rotor 90, variable volume pumping chambers are formed between the inner and outer rotors 80, 90 to drive fluid flow. As can be seen from FIG. 2, the pump 50 operates without a crescent shaped seal or insert in the chamber 56.

A plurality of chambers 140 are formed between the inner rotor 80 and the outer rotor 90. Each chamber 140 has a variable volume as the pump 50 operates. Each chamber 140 increases in volume to draw in the fluid from the inlet 58, and then decreases in volume to push the fluid out of the outlet 60. A chamber that is increasing in volume is shown at 142. A chamber that is decreasing in volume is shown at 144. As the inner rotor 80 rotates, the spacing between the outer wall 84 of the inner rotor 80 and the inner wall 92 of the outer rotor 90 changes at various radial locations about the inner rotor 80. The chamber formed by the inner rotor, vanes, and cam near the inlet port 58 increases in volume, which draws fluid into the chamber from the inlet port 58. The chamber near the outlet port 60 is decreasing in volume, which forces fluid from the chamber into the discharge port 60 and out of the pump.

Figure 5:
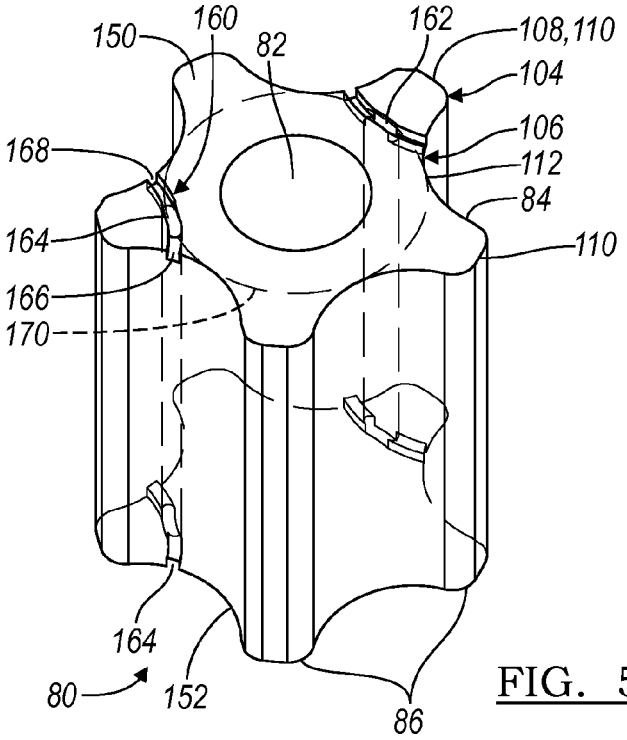
FIG. 5 illustrates a perspective view of an inner rotor of the gerotor pump of FIG. 2.

The inner rotor 80 is shown in detail in FIG. 5. The inner rotor 80 has a first end 150 and a second opposed end 152 spaced apart from the first end 150. The first end 150 is configured to mate with the planar surface 76 of the housing 52, and the second end is configured to mate with the planar surface 78 of the cover 54.

The inner rotor 80 has at least one fluid passage 160 therein. Each fluid passage 160 is defined by a respective tooth of the inner rotor 80 and is internal in the tooth. Other teeth in the inner rotor 80 are provided without fluid passages 160, or are independent of fluid passages 160. Note that a conventional inner rotor is without passages 160. The inner rotor 80 may have one fluid passage 160, two fluid passages 160 as shown, or more than two fluid passages 160. Generally, the fluid passage 160 is configured to disrupt harmonics during operation of the pump 50 to reduce pressure ripples and associated tonal noise. By placing a passageway 160 on some, but not all, of the teeth 86, the harmonics during pump operation are disrupted. The remaining teeth are solid or independent of passageways such that they maintain a fluid barrier with the notch as described below to maintain overall pumping efficiency.

Each fluid passage 160 is defined by a slot or an aperture 162 extending axially through the tooth, and extending from the first end 150 to the second end 152 of the inner rotor 80. The axial aperture 162 is generally parallel with the axis 70, and may be parallel with the axis 70, or offset by up to ten degrees. The aperture 162 may be radially aligned with the top land 108 of its tooth, as shown, or may be offset by a specified number of degrees. The axial aperture 162 of each passage 160 is positioned radially inward of a dedendum circle 170 or root circle of the inner rotor. In one example, the aperture 162 has cross-sectional dimensions of approximately 3 millimeters by 1.5 millimeters.

The passage 160 also has grooves or channels 164 defined by the ends 150, 152 that are fluidly connected to the aperture 162. Each channel 164 extends across the associated tooth on an end face 150, 152 of the inner gear member. Each channel 164 has a first end 166 that intersects the side wall of the inner rotor on an upstream side or face of the tooth or adjacent to a dedendum region 106 on a first side of the tooth. Each channel also has a second end 168 that intersects the side wall of the inner rotor on the downstream side or face of the tooth or adjacent to a dedendum region 106 on the second side of the tooth. Each groove or channel 164 extends across the respective tooth to fluidly connect adjacent pumping chambers 140 partially defined by the tooth. In other examples, the grooves or channels 164 may only extend to a single side of the tooth, e.g. by extending to a common upstream or downstream face of the tooth, or with opposed grooves or channels extending to opposite tooth faces. The aperture 162 intersects the grooves 164 in an intermediate region or central region of the groove 164 or tooth.

Each fluid passage 160 may have an aperture 162 and/or groove(s) 164 that are uniform along their length. In alternative examples, the portions of the fluid passage 160 may have sections with increasing and/or decreasing tapered shapes along their length. The aperture 162 and/or grooves 164 may have various cross-sectional shapes including circular, elongated, elliptical, slotted, triangular, parabolic, other smooth continuous curves and/or linear discontinuous shapes. The cross-sectional shape of the aperture and/or groove may be constant or may change along its length. The apertures and/or grooves may be the same size as shown, or may be different sizes. The fluid passages 160, apertures 162 and/or grooves 164 may be similarly positioned with respect to each tooth, or may be positioned differently relative to each tooth and the inner rotor 80.

The body of the inner gear member 80 or inner rotor defines a series of (N) teeth 86, with (N/2) or fewer teeth each defining a passage 160. The (N/2) or fewer teeth are nonsequentially arranged in the series of teeth such that at least one tooth without a fluid passage 160 is positioned between two teeth each having a passage 160. Therefore, the teeth with fluid passages 160 are nonadjacent to one another, and only two consecutive pumping chambers 140 may be in fluid communication with each other. Note that the outer gear member 90 has a series of (N−1) teeth. Alternate teeth in the series of teeth 86 or fewer teeth may be provided with fluid passages. For an inner rotor 80 with more than one tooth having fluid passageways 160, as shown in FIG. 2, a continuous or solid tooth is positioned between these teeth such that no more than two adjacent pumping chambers 140 are in fluid communication with one another. In other words, the teeth with fluid passageways 160 may be arranged on the rotor 80 such that they are non-sequential or non-adjacent.

In the example shown in FIG. 5, N=5 such that the inner rotor 80 is provided with five teeth 86. Two of the teeth are provided with a respective fluid passage 160, and the remaining three teeth are independent of fluid passages 160.

The planar surface 76 of the housing 52 defines a notch 180, pocket, or recess that is in fluid communication with the fluid outlet 60. The notch 180 extends radially inwards from the outlet 60 towards the axis 70. The planar surface 78 of the cover 54 defines a notch 182, pocket, or recess that is in fluid communication with the fluid outlet 60. The notch 182 extends radially inwards from the outlet 60 towards the axis 70. In some examples, the pump 50 has only a single notch and channel(s) 164 of the fluid passage(s) 160 on the end of the inner rotor 80 that mates with the planar surface having the notch. In other examples, the pump 50 has two opposed notches 180, 182 as shown, for use with an inner rotor 80 with channels 164 on both ends. The notches 180, 182 may be aligned with one another along a common radial, or may be offset from one another. The notches 180, 182 are positioned to extend radially inboard of a dedendum circle 170 of the inner rotor 80.

Figure 6:
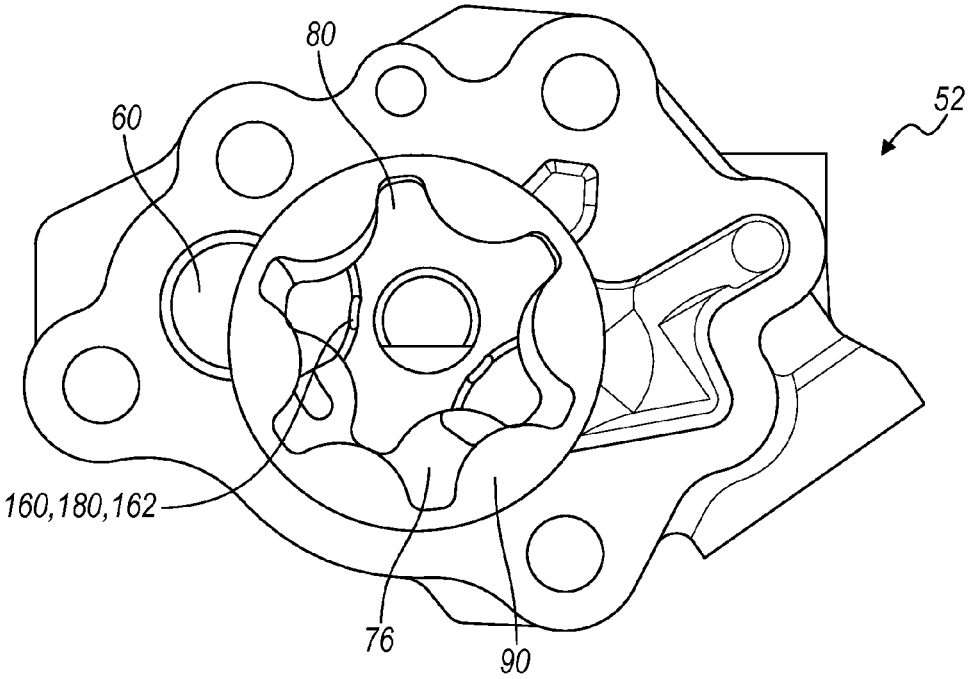
FIG. 6 illustrates a top view of the pump of FIG. 2 with the cover removed and the inner rotor in a first position.

Each notch 180, 182 and the fluid passage 160 cooperate to provide a fluid connection or a fluid pathway between a first pumping chamber associated with a first end 160 of the channel and the fluid outlet 60 and between a second pumping chamber associated with a second end 162 of the channel and the fluid outlet 60. The fluid connection is provided as the inner rotor rotates and the aperture 162 is aligned with or in register with the notches 180, 182, as shown in FIG. 6. Each notch 180, 182 is otherwise blocked by the inner gear member 80 to prevent fluid flow through the notch 180, 182 to the fluid outlet 60, e.g. in inner rotor 80 rotational positions where the aperture 162 overlies or is in register with the planar surfaces 76, 78.

The aperture 162 in the fluid passage 160 in the inner rotor 80 is blocked by the planar surfaces 76, 78 unless it is aligned with or in register with the notches 180, 182 and facing the outlet port 60, such that fluid flows through the grooves 164 and the aperture 162 into the outlet port 60.

As the gerotor pump 50 operates, pressure ripples of the fluid in the pump 50 may act as a source of excitation to powertrain components, for example, when the pump 50 is mounted to the powertrain components. The fundamental frequency of the peak pressure and its harmonics correspond to the number (N) of inner rotor teeth. For example, the pump 50 may be mounted to an engine block, a transmission housing, an oil pan or sump housing, a transmission bell housing, and the like, where the pressure ripples may cause tonal noise or whine from the engine or the transmission. The inner rotor 80 design of the present disclosure acts to reduce or eliminate the oil pump-induced powertrain whine or tonal noise by providing pressure relief or acting in a bypass capacity.

The pump 50 has an inner rotor 80 with fluid passages 160 with a slotted hole 162 or apertures 162 and grooves 164 in at least one of the teeth 86 that acts to break down the harmonics of the pump. The grooves 164 are on the top and bottom faces 150, 152 of the inner rotor 80 and are connected through a hole or aperture 162 extending axially through the tooth. This axial hole or aperture 162 is blocked unless it is facing the outlet port 60 during which the oil flows through the grooves and the hole 162 into the outlet port 62 via a notch 180, 182 or pocket in the port. Since the grooves 164 and the hole 162 are implemented in only some of the teeth, e.g. in one or two teeth, and not all the teeth, the oil pump main order and its harmonics breaks down over a larger frequency range with reduced pressure fluctuations and reduced harmonics amplitude.

Conventional gerotor pumps exhibit strong pressure spikes over a very narrow band frequency limited to the pump orders. The pump 50 according to the present disclosure reduces the pressure spikes and spreads them over a larger frequency range. The lower amplitude pressure spikes along with an increased frequency and more uniform frequency distribution provides for tonal noise reduction.

The fluid passages 160 of the inner rotor 80 and associated notches 180, 182 in the housing 52 and cover 44 provide pressure relief for the pump 50 and act to reduce the tonal noise or whine. As the pump 50 operates, fluid within variable volume chambers 140 adjacent to the outlet 60 is able to flow from the chambers 140 through the grooves 164 to the aperture 162 and notches 180, 182 and to the outlet region 60. Modeling and testing of the inner rotor 80 with the fluid passages 160 and notches 180, 182 show improved pump 50 operating characteristics compared to a pump having a conventional inner rotor and pump housing. Modeling results are provided in FIGS. 7-8 and are based on a gerotor pump with an inner rotor 80 having five teeth 86 and operating at 4000 rpm as determined using computational fluid dynamics (CFD) analysis. A gerotor pump 50 having the inner rotor 80 as described herein showed a reduction in pressure ripples or spikes during operation. The passageways 160 and notches 180, 182 act to break down the harmonics caused by the rotation of the inner rotor 80 and act to reduce the pressure ripples and reduce the tonal noise or whine by providing pressure relief and limited fluid flow from adjacent pumping chambers to the pump outlet.

Modeling results of the average volumetric flow rate (gallons per minute) of a conventional pump compared to the pump 50 showed comparable flow rates. For example, with considered geometrical dimensions at 4000 rpm, approximately a 2% reduction in flow rate for the pump 50 compared to a conventional pump is predicted.

Figure 7:
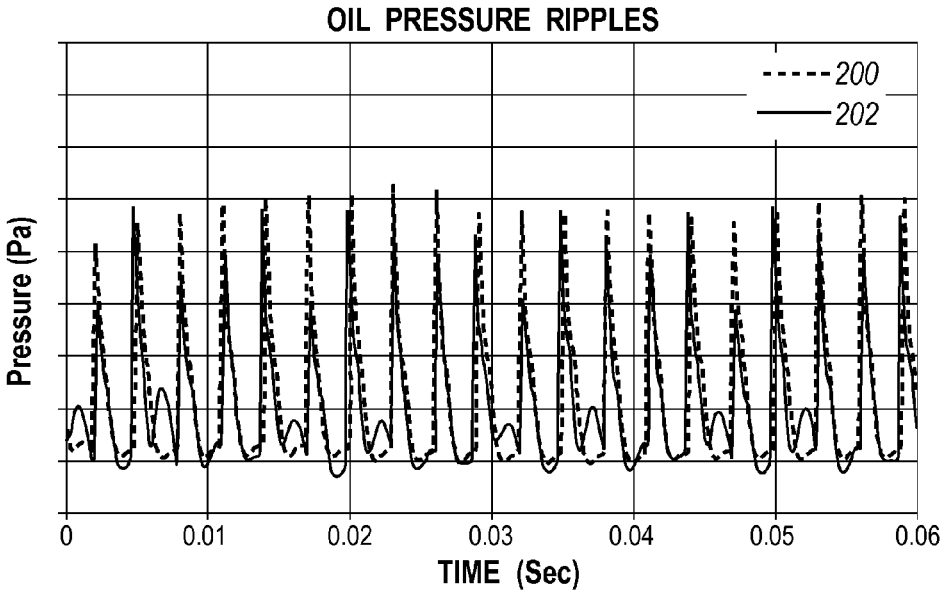
FIG. 7 illustrates a graph of pressure output from the pump of FIG. 2 compared to a pressure output from a pump with a conventional idler rotor.

For example, as shown in FIG. 7, a conventional pump while operating may provide fluid at the outlet of the pump with pressure fluctuations or pressure waves as shown by line 200 during a steady state operating condition. These pressure fluctuations are a difference between a maximum fluid pressure or spike and a minimum fluid pressure at the outlet. The pump 50 according to the present disclosure has a pressure fluctuation as shown by line 202 for the same steady state operating condition. The pump 50 according to the present disclosure provides for a comparable fluid pressure at the pump outlet compared to the conventional pump across a range of pump speeds. Therefore, the pump 50 according to the present disclosure does not incur any significant losses based on differences in efficiencies, etc.

Figure 8:
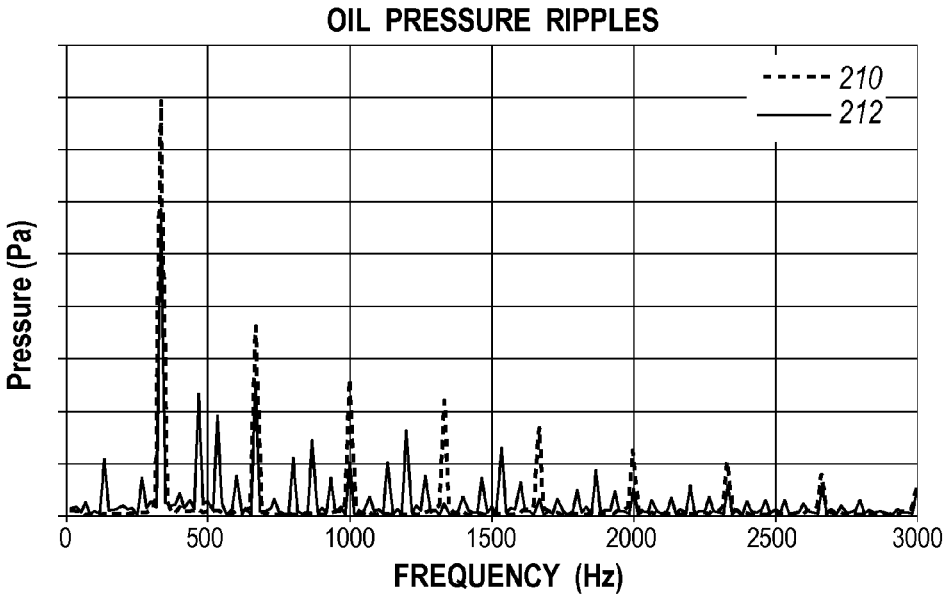
FIG. 8 illustrates a frequency domain analysis for the pump of FIG. 2.

FIG. 8 shows the pressure ripples profiles in the frequency domain at the outlet of the pump 50 according to the present disclosure compared to a conventional pump. An analysis across a frequency domain showed a significant decrease in pressure peaks for the various orders of the pump 50, with the pressure peaks essentially disappearing for the higher orders as shown in FIG. 8, with a conventional pump illustrated by line 210, and a pump 50 according to the present disclosure illustrated by line 212. The fundamental frequency of the pump, i.e., first order, and the higher order harmonics are determined by the number of teeth 86 on the inner rotor 80. The inner rotor 80 of the pump has five teeth, therefore, for the pump running at 4000 rpm, the harmonic orders of the pump due to the pressure pulsations are multiples of five with the first order at 333 Hertz and the second order appearing at 666 Hertz.

From FIG. 8 in the frequency domain, the lower pressure amplitudes for orders beyond the fundamental orders may be seen, and is a typical characteristic of gerotor pumps. The tonal noise is usually due to the higher orders of the pump and reduction in amplitude for the first order which corresponds to the pump pressure ripples usually is not enough to resolve the whine issue. For a vehicle component oil pump NVH assessment, pump pressure fluctuations at higher frequency orders are therefore considered, and may be decreased to reduce tonal noise.

The pump 50 according to the present disclosure provides for decreased noise. For example, when the pump 50 according to the present disclosure is used with a powertrain for a vehicle the tonal noise from the powertrain is reduced. The tonal noise reduction using the pump 50 may provide for reduced noise, vibration, and harshness (NVH) from the powertrain. Additionally, the powertrain or lubrication system may be simplified using a pump 50 according to the present disclosure. For example, the powertrain or lubrication system with a conventional pump may include noise reduction devices or features, and these features may be eliminated by switching to a pump according to the present disclosure. In one example, the conventional lubrication system includes a damping material such as a mastic located on the oil sump, and this damping material may be removed by switching to a pump 50 as described herein without an increase in tonal noise from the powertrain.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A gerotor pump comprising:

a pump housing defining a chamber and having a fluid inlet and a fluid outlet;

an outer gear member supported for rotation within the chamber about a first axis, the outer gear member having a series of internal teeth; and an inner gear member rotatably supported within the outer gear member about a second axis spaced apart from the first axis, the inner gear member defining a series of external teeth with a first tooth having a fluid passage therethrough and a second tooth independent of fluid passages, wherein the fluid passage is defined by an aperture extending axially through the first tooth fluidly connected to a channel extending across the first tooth on an end face of the inner gear member;

wherein the fluid passage is configured to disrupt harmonics during operation to reduce pressure ripples and associated tonal noise;

wherein the pump housing is provided by a pump body and a cover, one of the pump body and the cover defining a planar surface supporting the outer gear member and the inner gear member, the planar surface defining a notch in fluid communication with the fluid outlet;

wherein the inner gear member and the outer gear member cooperate to form a plurality of variable volume pumpling chambers to pump fluid from the fluid inlet to the fluid outlet; and wherein the notch and the fluid passage cooperate to provide a fluid connection between a first pumping chamber associated with a first end of the channel and the fluid outlet and between a second pumping chamber associated with a second end of the channel and the fluid outlet;

wherein the fluid passage is further defined by another channel extending across the first tooth on another end face of the inner gear member, the another channel fluidly connected to the aperture;

wherein the other of the pump body and the cover defines another planar surface supporting the outer gear member and the inner gear member, the another planar surface defining another notch in fluid communication with the fluid outlet; and wherein the another notch and the fluid passage cooperate to provide a fluid connection between the first pumping chamber associated with a first end of the another channel and the fluid outlet and between the second pumping chamber associated with a second end of the another channel and the fluid outlet.

2. The pump of claim 1 wherein the notch extends radially inward from the fluid outlet.

3. The pump of claim 1 wherein the notch is otherwise blocked by the inner gear member to prevent fluid flow through the notch to the fluid outlet.

4. The pump of claim 1 wherein the another notch is otherwise blocked by the inner gear member to prevent fluid flow through the another notch to the fluid outlet.

5. The pump of claim 1 wherein the fluid passage of the first tooth is the only fluid passage defined within the series of teeth of the inner gear member.

6. The pump of claim 1 wherein the aperture of the fluid passage is parallel with the second axis.

7. The pump of claim 1 wherein the inner gear member defines a first end and a second end spaced apart therefrom, the aperture of the fluid passage extending between the first and second ends.

8. The pump of claim 1 wherein the aperture of the fluid passage is radially aligned with a top land of the first tooth.

9. The pump of claim 1 wherein the channel of the fluid passage has a first end adjacent to a dedendum region on a first side of the first tooth, and a second end adjacent to a dedendum region on a second side of the first tooth.

10. The pump of claim 1 wherein the inner gear member has (N) teeth, and the outer gear member has (N+1) teeth.

11. The pump of claim 1 wherein the inner gear member has a third tooth in the series of teeth, the third tooth defining another fluid passage therethrough, the another fluid passage defined by another aperture extending axially through the third tooth fluidly connected to another channel in the end face of the inner gear member extending across the third tooth.

12. The pump of claim 11 wherein the first tooth is nonadjacent with the third tooth in the series of teeth.

13. A gerotor pump comprising:

a housing having a planar surface separating an inlet and an outlet with a notch extending radially inwardly therefrom; and an inner rotor positioned within an idler rotor, and having a tooth defining a passage therethrough and another tooth without passages therethrough;

wherein the notch is blocked by the inner rotor to prevent flow therethrough to the outlet unless the passage and the notch are overlapped and form a fluid pathway.

14. The pump of claim 13 wherein the inner rotor has a first end and a second opposed end, the first end configured to mate with the planar surface, and wherein the passage is defined by a first groove in the first end intersecting an aperture and a second groove in the second end intersecting the aperture, the aperture extending between the first and second ends, the first and second grooves extending across the tooth to fluidly connect adjacent pumping chambers partially defined by the tooth.

15. An inner rotor for a gerotor pump comprising:

a body having first and second ends separated by an outer wall defining a series of (N) teeth, wherein (N/2) or fewer teeth each define a passage and are nonsequentially arranged in the series of teeth, each passage having an axial aperture extending through the body and intersecting first and second grooves defined by the first and second ends, respectively, and extending across the respective tooth.

16. The inner rotor of claim 15 wherein each of the first and second grooves has a first end intersecting an upstream face of the respective tooth and a second end intersecting a downstream face of the respective tooth.

17. The inner rotor of claim 16 wherein the axial aperture of each passage is radially inward of a dedendum circle of the inner rotor.

* * * * *